US008366218B2

(12) United States Patent
Janzen et al.

(10) Patent No.: US 8,366,218 B2
(45) Date of Patent: Feb. 5, 2013

(54) MOUNTING DEVICE FOR A FURNITURE PART AND ITEM OF FURNITURE

(75) Inventors: Jörg Janzen, Feldkirch (AT); Markus Albrecht, Lustenau (AT)

(73) Assignee: Grass GmbH, Hochst (AT)

( * ) Notice: Subject to any disclaimer, the term of this patent is extended or adjusted under 35 U.S.C. 154(b) by 166 days.

(21) Appl. No.: 13/031,959

(22) Filed: Feb. 22, 2011

(65) Prior Publication Data

US 2011/0204761 A1 Aug. 25, 2011

(30) Foreign Application Priority Data

Feb. 22, 2010 (DE) ..... 20 2010 002 621 U

(51) Int. Cl.
*A47B 88/00* (2006.01)

(52) U.S. Cl. ..... 312/334.1

(58) Field of Classification Search ..... 312/334.1, 312/334.4–334.5
See application file for complete search history.

(56) References Cited

U.S. PATENT DOCUMENTS

| | | | | |
|---|---|---|---|---|
| 4,810,045 | A * | 3/1989 | Lautenschlager | 312/334.5 |
| 5,281,021 | A * | 1/1994 | Rock et al. | 312/334.32 |
| 5,302,016 | A * | 4/1994 | Lautenschlager et al. | 312/333 |
| 5,439,283 | A * | 8/1995 | Schroder et al. | 312/334.4 |
| 5,580,139 | A * | 12/1996 | Grabher | 312/333 |
| 5,588,729 | A * | 12/1996 | Berger | 312/334.4 |
| 5,632,541 | A * | 5/1997 | Uthoff | 312/333 |
| 6,913,334 | B2 * | 7/2005 | Weichelt | 312/334.4 |
| 6,945,618 | B2 * | 9/2005 | Kim et al. | 312/334.4 |
| 7,549,712 | B2 * | 6/2009 | Booker et al. | 312/334.6 |
| 7,654,625 | B2 * | 2/2010 | Amann et al. | 312/334.44 |
| 8,016,374 | B2 * | 9/2011 | Kropf et al. | 312/333 |
| 2004/0095047 | A1 * | 5/2004 | Salice | 312/332.1 |

FOREIGN PATENT DOCUMENTS

| | | |
|---|---|---|
| DE | 20 2005 005489 U1 | 7/2005 |
| DE | 20 2005 020 025 U1 | 6/2007 |

* cited by examiner

*Primary Examiner* — Hanh V Tran
(74) *Attorney, Agent, or Firm* — Burr & Brown

(57) ABSTRACT

The invention relates to an item of furniture and a device for detachably mounting a furniture part on a guide unit, by means of which the furniture part is accommodated on a furniture body so as to be displaceable, and the guide unit includes a body rail that is associated with the furniture body and a movement rail that is associated with the furniture part. A mounting mechanism is present and includes an attachment part, which is mountable on the guide unit and is adjustable from a pre-assembly state mounted on the guide unit into a final assembly state, in which the furniture part is mountable on the guide unit in the intended manner by means of the mounting means.

8 Claims, 3 Drawing Sheets

MOUNTING DEVICE FOR A FURNITURE PART AND ITEM OF FURNITURE

BACKGROUND OF THE INVENTION

Different connecting or mounting mechanisms are used on items of furniture for the assembly of the same from individual components and these mechanisms include guide units for the moveable accommodation of furniture parts on a furniture body. In this case, it is possible to use attachment parts that serve to connect furniture parts to the guide unit and, where applicable, have further functions, such as, for example, a possibility of adjusting parts in relation to one another. The attachment parts, before they assume a definitive final assembly position on the item of furniture, are frequently moved in a position that differs from said final assembly position, for example in a pre-assembly position on the item of furniture or on a furniture part.

SUMMARY OF THE INVENTION

It is the object of the present invention to provide attachment parts for items of furniture with regard to assembly-friendly usage, said attachment parts in particular being necessary for the assembly and disassembly of components of the items of furniture.

The invention proceeds from a device for detachably mounting a furniture part on a guide unit, by means of which the furniture part is accommodated on a furniture body so as to be displaceable, and the guide unit includes a body rail that is associated with the furniture body and a movement rail that is associated with the furniture part, wherein mounting means are present which include an attachment part, which is mountable on the guide unit and is adjustable from a pre-assembly state mounted on the guide unit into a final assembly state, in which the furniture part is mountable on the guide unit in the intended manner by means of the mounting means. As a rule, the mounting of the furniture part on the guide unit is effected with the guide unit in the state mounted on the body by means of the body rail.

An essential aspect of the invention is that the attachment part has realized thereon a contact portion, which, with the attachment part present in the pre-assembly state on the guide unit, is adapted to a counter portion on the guide unit and/or on the furniture body in such a manner that, with a movement of the movement rail in the manner intended for use, the contact portion and the counter portion are moveable relative to each other and, at the same time, contact each other such that the attachment part is adjusted from the pre-assembly state into the final assembly state. A movement of the movement rail in the manner intended for use is effected by displacing the movement rail in relation to the body rail by means of bearing means between the rails that are present for this purpose. In accordance with said movement, the furniture part secured on the movement rail is moved into its open and closed position in operation. If the guide unit is realized as a full pull-out, the movement rail is displaced along a central rail that is present between the body rail and the movement rail, the central rail also being displaced.

According to the invention, a relative movement of the movement rail to the body rail is always linked to the movement of the movement rail in the manner intended for use, which ensures the transfer from the pre-assembly state into the final assembly state. A very assembly-friendly arrangement is consequently provided. It can be ruled out, in particular, that an attachment part remains in the pre-assembly state because, for example, a fitter forgets to move the attachment part into the final assembly position, which has not been ruled out up to now, also because the attachment part is no longer within the fitter's field of vision once the furniture part has been placed in position or is covered by the furniture part or body portions and, in addition, is accessible only with difficulty.

By means of the first-time displacement of the moveable furniture part that takes place every time, and consequently with the displacement of the movement rail in relation to the body rail after the assembly of the furniture part, that is to say at the latest as soon as the item of furniture is put in operation or in use, a positionally-correct final assembly position of the attachment part is automatically or independently obtained. In the final assembly position, functions connected to or realized with the attachment part can additionally be set up and these can, in particular, also be functions relevant to securement. These switching or assembly positions that are beneficial to securement can consequently be set up in a targeted or provoked manner.

The contact portion can be realized, for example, as a portion additionally present on known attachment parts, for example as a one-piece extension or integral moulding or elongation. However, it is also conceivable for the contact portion to be mounted on the attachment part as an additional part.

With the interaction between contact portion and counter portion, positive control, so to speak, is realized by means of portions colliding in a targeted manner, the attachment part being mounted on the guide unit so as to be moveable. By way of the attachment part, in the final assembly position, even an adjustment movement can be provided by way of which, for example, a manual adjustment can be performed with regard to a fine adjustment of the position of the furniture part in relation to the guide unit. Such an adjustment movement integrated in the attachment part with, for example, parts of the attachment part that are displaceable in relation to each other along inclined surfaces, must be looked at separately or independently to the movement of the complete attachment part from the pre-assembly position into the final assembly position. However, it is preferably also possible for the two movements to be moveable about a common spatial axis, e.g. pivotable about a common axis of rotation.

In addition, it is a further essential aspect of the invention that the attachment part has realized thereon a contact portion which, with the attachment part present in the pre-assembly state on the guide unit, is adapted to a counter portion on the guide unit and/or on the furniture body in such a manner that, with a movement of the movement rail in the manner intended for use, the contact portion and the counter portion are moveable relative to each other and, at the same time, contact each other such that in the pre-assembly state a movement of the movement rail in an insertion direction is prevented at a stop position, which is at a spacing from an end point of an insertion path of the movement rail when it is moving in the manner intended for use, wherein the contact portion is realized in a targeted manner for an intended use in such a manner that, by overcoming a preselectable force in the insertion direction, the movement rail can be pushed further in from the stop position.

Through the contact, the continued movement of the movement rail is accordingly stopped at a position which is at a spacing from an end point of a displacement path of the movement rail when it is being moved in the manner intended for use.

Consequently, by way of the attachment part, compared to previous attachment parts which only fulfil a function on the item of furniture in the final assembly position, in an advantageous manner an additional function is provided in its pre-assembly position. Since when the furniture part is assembled on the guide unit, which is secured to the body by means of the body rail, it is a problem that through the slightest action from outside, the guide unit moves into the body, according to the invention the guide unit can be held temporarily in an extended position. This simplifies the assembly immensely or increases the ease of assembly. For example, the mounting or suspending of a pull-out or a drawer on the guide unit can be managed without any problem in the stationary state of the guide unit. Up to now, it is extraordinarily difficult and arduous or almost impossible for one person on their own to place in position or to set up in particular a larger pull-out on the movement rail of the mounted guide unit. In particular as, in the case of modern guide units, an extended movement rail moves into the body in an almost resistance-free manner just through a light touch.

Thus, before the pull-out is mounted on the guide unit, the movement of the movement rail can be stopped at the stop position by way of the attachment part, which is in its pre-assembly position. Once the furniture part has been mounted, by overcoming the preselectable force, which results in the lifting of the movement block, the mounted drawer can be moved back and forth by means of the guide unit in the usual movement sequence in relation to the body. It is particularly advantageous when the transferring of the attachment part from the pre-assembly position into the final assembly position is coupled to the overcoming of the preselectable force. Consequently, along with the aforementioned advantages, the advantages already discussed above in relation to the first aspect of the invention are additionally achieved.

In addition, it is advantageous for the mounting means to include precisely one attachment part, which is mountable on an accommodating portion of the guide unit, in particular the movement rail. For easy operation of the attachment part, for example if an adjusting function is integrated, the accommodating portion is located, for example, close to the front end of the movement rail. The accommodating portion can be realized, in particular, on the guide unit without additional parts, for example it can include an opening or a cutout adapted to the shape of the attachment part in existing portions of the movement rail. The accommodating portion and the attachment part are preferably adapted to each other such that the attachment part in the pre-assembly state is held in a sufficiently sturdy and non-detachable manner on the guide unit, e.g. for its transport or its assembly on the body. The attachment part can preferably be mounted on the guide unit or removed again from said guide unit in a manual manner.

In addition, it is advantageous for the attachment part to be accommodated on the guide unit so as to be pivotable such that the attachment part is adjustable from the pre-assembly state into the final assembly state by means of pivoting. In a mounting position on the guide unit, an attachment part that is mounted on the guide unit so as to be pivotable can be pivoted from the pre-assembly position into the final assembly position and back in a secure manner by means of pivoting back and forth. However, other forms of movement for pivoting are also possible as alternatives or are conceivable in a superimposed manner for the pivotal movement. For example, the attachment part can be accommodated on the guide unit so as to be displaceable.

It is also proposed that the attachment part is lockable on the guide unit in the pre-assembly state, wherein for the adjustment into the final assembly state, the lock can be lifted by acting on the contact portion. Thus the attachment part can be secured in the pre-assembly state with a preselectable force, for example by means of the accommodating portion. For example, it is then also advantageous to provide a delivery state of the guide unit with the attachment part attached, in which state the attachment part is locked in the pre-assembly state. The lock can include spring means that provide a permanent locking force by means of the spring force. If the spring force is overcome, the lock can be at least partially lifted in order to detach the attachment part from the guide unit or to move it into the final assembly position. In the final assembly position, the spring force can once again serve as locking force such that the final assembly position is secured in a corresponding manner.

The mounting means are preferably realized for securing the furniture part against unwanted lifting off and/or shifting in relation to the guide unit. Thus a furniture part can be held securely in position on the guide unit by way of the mounting means. Precisely one attachment part is preferably present on a guide unit, for example on a full pull-out rail, said attachment part securing a furniture part accommodated on the guide unit against lifting off and shifting. Where applicable, a vertical positioning of the furniture part in relation to the guide unit can also be performed by way of the attachment part.

In a further development of the invention, according to the invention, in particular relating to a variant of the attachment part, there is provided a base body that is securable to an accommodating portion on the guide unit and an engagement element, which, in the secured state of the furniture part, protrudes on the guide unit in such a manner that the engagement element engages in a recess in the furniture part, and wherein adjustment means are present for the vertical positioning of the secured furniture part in relation to the guide unit. Thus, a furniture part, for example a drawer, can be fixed in a secured manner on the guide unit, the secured state of the moveable furniture part on the guide unit not being effected until transfer from the pre-assembly position into the final assembly position. In reverse, taking off or removing or disassembling the moveable furniture part from the guide unit is not possible until the final assembly position has been lifted or there has been a return to the pre-assembly position.

The invention also relates to an item of furniture having a furniture body, on which a furniture part is mountable and displaceably guided by means of a guide unit, one of the abovementioned devices being present. Thus the advantages shown can be realized in a corresponding manner on the furniture.

BRIEF DESCRIPTION OF THE DRAWINGS

Further features and advantages of the invention are explained by way of the exemplary embodiments shown in the Figures, in which, in detail.

DETAILED DESCRIPTION OF THE INVENTION

Figure 1:
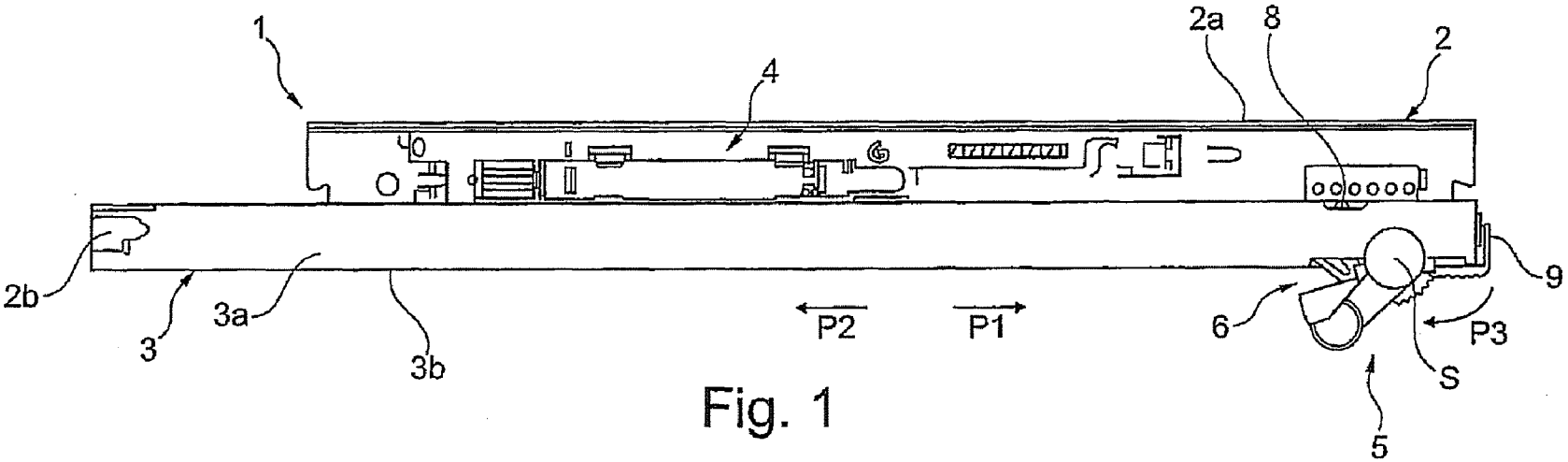
FIG. 1 shows an attachment part of a mounting device according to the invention in a pre-assembly position on a guide unit.

FIG. 1 shows a top view of a guide unit that is realized as a drawer guide 1 for displaceably guiding a furniture part or a drawer in relation to a furniture body. The drawer and the body are not shown in the Figures. The drawer is accommodated in each case on opposite side walls of the body by means of the drawer guide 1 and a further drawer guide (not shown) that is realized as a mirror image to the drawer guide 1. For the connection to the side walls, the drawer guide 1 includes a body rail 2, which is mountable on the side walls of the body and abuts against an inside wall of the body by means of a web 2*a* standing vertically upward and, for example, is screw-connected thereto. The drawer is placed on top of a movement rail 3 of the drawer guide 1, which is effected on the drawer guide 1 that is provided in FIG. 1 and is mounted on the body. For the fixing of a drawer rear side, there is an upwardly and forwardly angled projection 2*b* in the rear region of the drawer guide 1, said projection, with the drawer mounted, engaging in a suitable opening at the back of the drawer. On the underside, the mounted drawer rests on a flat top side 3*a* of the drawer rail 3.

It is possible to have a central rail between the body rail 2 and the movement rail 3.

The movement rail 3 is displaceable from the central displacement position shown in FIG. 1 in relation to the body rail 2 in accordance with arrow P1 in an opening direction or in accordance with arrow P2 in a closing direction. Further elements of the drawer guide 1 such as an automatic retraction mechanism 4 with damping are not explained in any more detail.

In addition, a mounting device according to the invention is provided in a front end region of the movement rail 3, said mounting device having an attachment part in the form of a lift lock 5. The lift lock 5 serves, in the fully mounted state of a drawer on the drawer guide 1, to secure the drawer against lifting-off or shifting in relation to the movement rail 3. To this end, the lift lock 5 has to be transferred from a pre-assembly position on the drawer guide 1 as in FIG. 1 into a final assembly position as in FIG. 2 in order to secure the drawer placed thereon.

In order to mount the lift lock 5 on the movement rail 3, said lift lock is mounted or inserted on an accommodating contour 6 on the movement rail 3. The accommodating contour 6 can comprise, in particular, an accommodating opening 7 (FIG. 3), the accommodating opening 7 extending over the top side 3*a* and over a downwardly angled side web 3*b*.

The lift lock 5 can be slipped-on the movement rail 3 with a simple handle.

Figure 2:
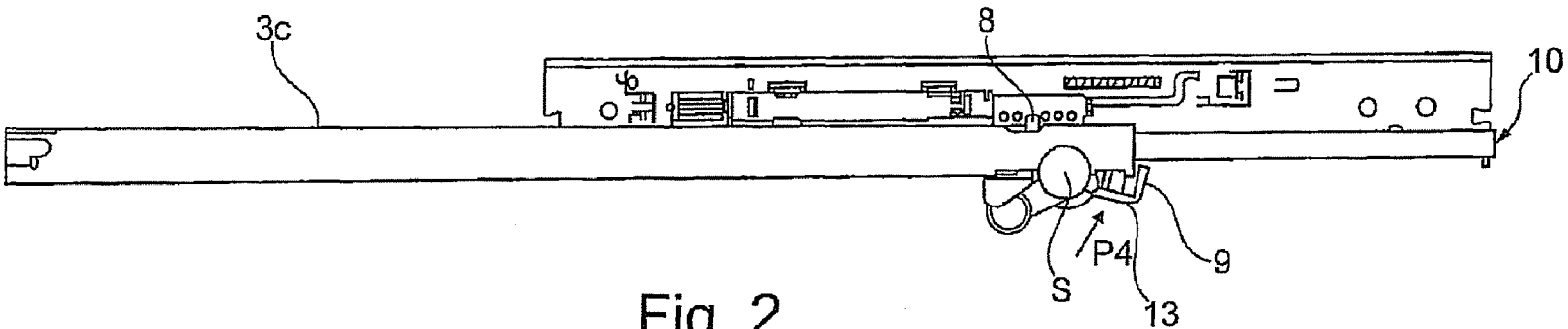
FIG. 2 shows the arrangement in FIG. 1 with the movement rail of the guide unit in a position that has been displaced compared to the position in FIG. 1.

The lift lock 5 is accommodated so as to be pivotable about a pivotal axis S and can be moved in this manner from the pre-assembly position into the final assembly position as in FIG. 2. In this case, a locking pin 8 engages the lift lock 5, which, in the final assembly position, protrudes over a side web 3*c* that is located opposite and parallel to the side web 3*b* (FIG. 2), into a suitable opening on the drawer and secures said drawer against noticeable lifting off or shifting. This means that, with the drawer placed in the correct position on the drawer guide 1 as in FIG. 1, the lift lock 5 has to be moved into the final assembly position as in FIG. 2, such that the locking pin 8 can engage in a corresponding opening on the drawer.

To this end, the lift lock 5 is pivoted about the pivotal axis S, which is perpendicular to the drawing plane, in the direction of the arrow P3 in FIG. 1. This can occur, in principle, by manually acting on the lift lock 5, which is, however, time-consuming and can possibly be forgotten during assembly. This is where the first aspect of the invention fits in. Accordingly, an angled cam 9 on the lift lock 5, which, in the pre-assembly position in FIG. 1, abuts at the end face against the front end of the movement rail 3 so as to surround the side web 3*b*, pivots in a forcible manner into the final assembly position as in FIG. 2 and pivots the lift lock 5. This occurs in that, proceeding from FIG. 1, when the movement rail 3 is inserted according to arrow P2, with the drawer mounted thereon, through contacting or collision between an inside of the cam 9 and an end face 10 of the body rail 2, the lift lock 5 is forcibly pivoted.

The advantage here is that no further assembly step is necessary to transfer the lift lock 5 into the final assembly position.

During the operation of the drawer guide 1 with the drawer mounted thereon, the lift lock 5 remains in the final assembly position. If the drawer is subsequently removed from the guide unit or drawer guide 1, it is simply necessary to set the pre-assembly position as in FIG. 1, which can be effected by pressing in accordance with arrow P4 onto an abutment web 13 on the lift lock 5, which is possible when the movement rail 3 is extended. At the same time, the locking pin 8 is pivoted back again and the drawer can easily be removed from the guide unit 1.

Figure 3:
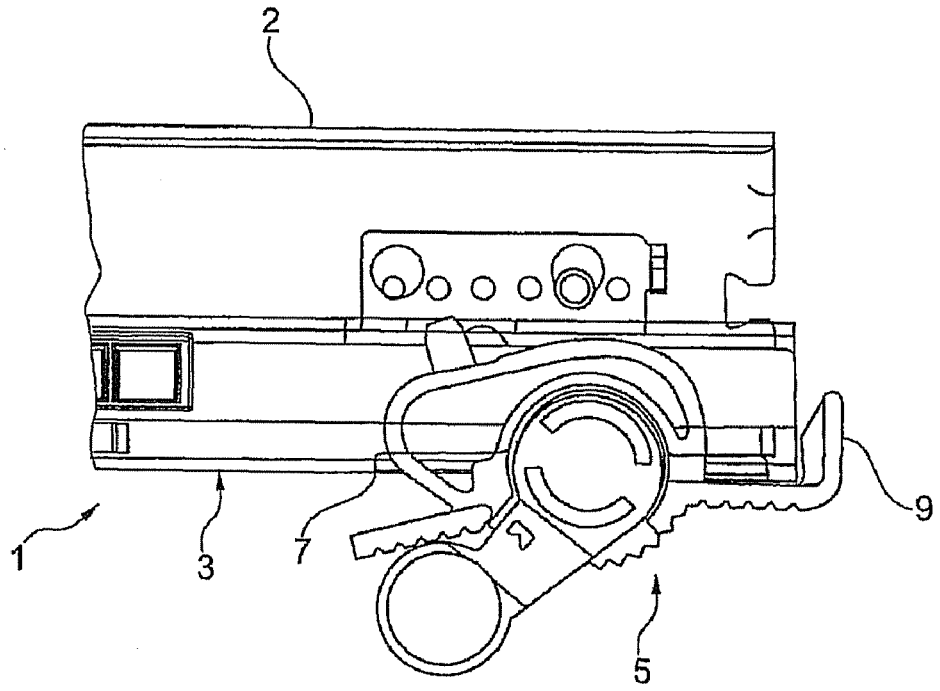
FIG. 3 shows an enlarged, sectional representation of an attachment part, which deviates slightly from the attachment part in FIG. 1, on a guide unit, omitting a top side of a movement rail, with the attachment part in a pre-assembly position.

In a detailed manner and omitting the top side 3*a*, FIG. 3 shows a lift lock 5, which has been slightly modified in relation to the arrangement in FIG. 1, on a drawer guide 1 having a movement rail 3 and a body rail 2.

Figure 4:
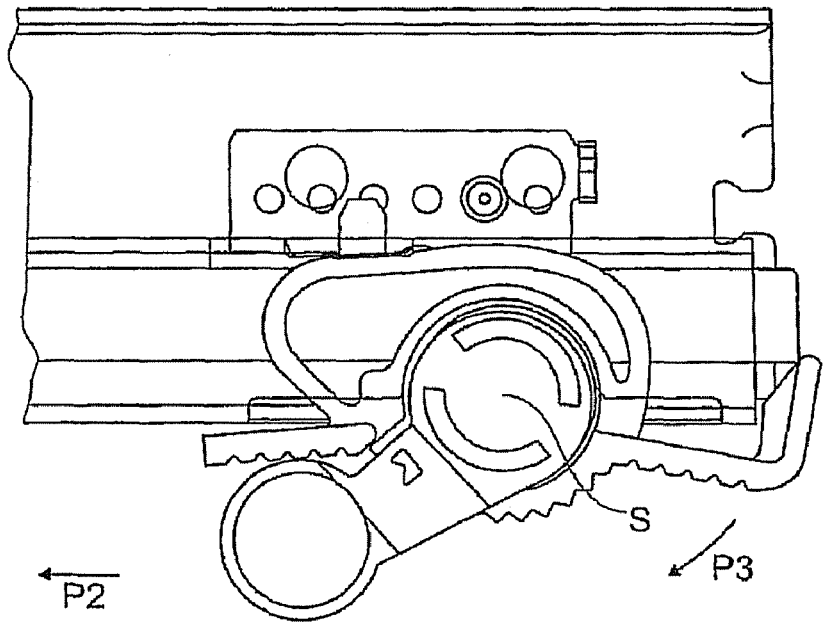
FIG. 4 shows the arrangement in FIG. 3 with the attachment part in a position that has been modified in relation to the pre-assembly position and FIG. 5 shows the arrangement in FIGS. 3 and 4 with the attachment part in a final assembly position.
Figure 5:
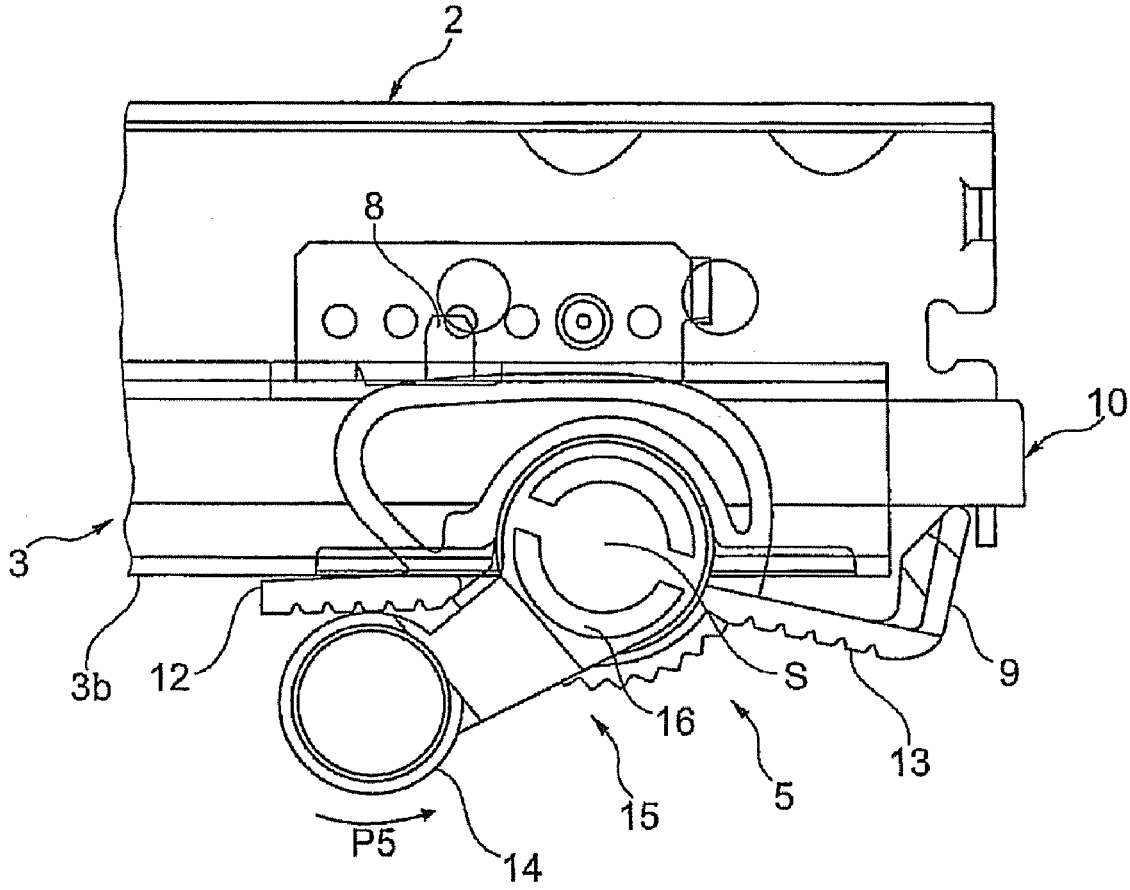

FIG. 4 shows the arrangement in FIG. 3 with the lift lock 5 in a position pivoted somewhat in the direction P3 by moving the movement rail 3 in the direction P2. The fully obtained final assembly position of the lift lock 5 corresponding to FIG. 2 is shown in FIG. 5.

The lift lock 5 also includes an operating lever 14, which can be modified by means of a locking mechanism 15, a support surface 16 being provided on which an underside of the drawer to be mounted rests and by means of the vertical position of which the vertical position of the drawer is also determined. The operating lever 14, as indicated in FIG. 5, is also pivotable about the pivotal axis S in the direction of the arrow P5 and back in opposition to P5 to set up a desired adjustment position and is lockable by means of a locking mechanism 15. This is adjustable manually by an operator.

In principle, the transfer from the pre-assembly position into the final assembly position and back can also be accomplished by acting, for example, by hand on abutment webs 12, 13 on the lift lock 5.

In place of the cam 9 in the exemplary embodiments, a pin, a flap, a strap, a lever or a spring in the form of, for example, a bending beam are also conceivable.

In the exemplary embodiments described, the adjustment of the lift lock 5 from the pre-assembly position into the final assembly position is triggered by a linearly guided component or by the linearly moveable movement rail 3, pivoting the lift lock 5 as a result. However, other movement combinations are also possible, in principle, for example a triggering by means of a component being pivoted past, followed by a linear triggering movement of an attachment part or locking part. Two parts could also slide past each other in an inclined manner in order to activate securement of the drawer.

With the cam 9 abutting against the end face 10 of the body rail 2, it is also achieved according to the invention that for assembling the drawer, the movement rail 3 does not move in further in the direction P2 than the position shown in FIG. 1.

Consequently, the drawer can easily be placed on the movement rail 3, which, in this case, protrudes forwards over the body. By overcoming a preselectable force in the insertion direction P2, it is subsequently possible to lift this holding mechanism and the drawer moves into the body.

LIST OF REFERENCES

1 Drawer guide
2 Body rail
2*a* Web
2*b* Projection
3 Movement rail
3*a* Top side
3*b* Side web
3*c* Side web
4 Automatic retraction mechanism
5 Lift lock
6 Accommodating contour
7 Accommodating opening
8 Locking pin
9 Cam
10 End face
11 -
12 Abutment web
13 Abutment web
14 Operating lever
15 Locking mechanism
16 Support surface

The invention claimed is:

1. A device for detachably mounting a furniture part on a guide unit, by means of which the furniture part is accommodated on a furniture body so as to be displaceable, and the guide unit includes a body rail that is associated with the furniture body and a movement rail that is associated with the furniture part, wherein mounting means are present which include an attachment part, which is mountable on the guide unit and is adjustable from a pre-assembly state mounted on the guide unit into a final assembly state, in which the furniture part is mountable on the guide unit in the intended manner by means of the mounting means, wherein the attachment part has a contact portion, which, with the attachment part present in the pre-assembly state on the guide unit, is adapted to a counter portion on the guide unit and/or on the furniture body in such a manner that, with a movement of the movement rail in the manner intended for use, the contact portion and the counter portion are moveable relative to each other and, at the same time, contact each other such that the attachment part is adjusted from the pre-assembly state into the final assembly state.

2. The device as claimed in claim 1, wherein the attachment part has a contact portion, which, with the attachment part present in the pre-assembly state on the guide unit, is adapted to a counter portion on the guide unit and/or on the furniture body in such a manner that, with a movement of the movement rail in the manner intended for use, the contact portion and the counter portion are moveable relative to each other and, at the same time, contact each other such that in the pre-assembly state a movement of the movement rail in an insertion direction is prevented at a stop position, which is at a spacing from an end point of an insertion path of the movement rail when it is moved in the manner intended for use, wherein the contact portion is realized in a targeted manner for an intended use in such a manner that by overcoming a preselectable force in the insertion direction, the movement rail can be pushed further in from the stop position.

3. The device as claimed in claim 1, wherein the mounting means consists of one attachment part, which is mountable on an accommodating portion of the guide unit, in particular the movement rail.

4. The device as claimed in claim 1, wherein the attachment part is accommodated on the guide unit so as to be pivotable such that the attachment part is adjustable from the pre-assembly state into the final assembly state by means of pivoting.

5. The device as claimed in claim 1, wherein the attachment part is lockable on the guide unit in the pre-assembly state, wherein for the adjustment into the final assembly state, the lock can be lifted by acting on the contact portion.

6. The device as claimed in claim 1, wherein the mounting means are realized to secure the furniture part against unwanted lifting off and/or shifting in relation to the guide unit.

7. The device as claimed in claim 1, wherein there is provided a base body that is securable to an accommodating portion on the guide unit and an engagement element, which, in the secured state of the furniture part, protrudes on the guide unit in such a manner that the engagement element engages in a recess in the furniture part, and wherein adjustment means are present for the vertical positioning of the secured furniture part in relation to the guide unit.

8. An item of furniture having a furniture body, on which a furniture part is mountable and displaceably guided by means of a guide unit, having a device as claimed in claim 1.

* * * * *